United States Patent [19]

Miyama et al.

[11] Patent Number: 4,903,658

[45] Date of Patent: Feb. 27, 1990

[54] CONTROL METHOD FOR IDLING SPEED OF AN ENGINE

[75] Inventors: Shuji Miyama; Hiroya Ohkumo, both of Tokyo, Japan

[73] Assignee: Fuji Jukogyo Kabushiki Kaisha, Tokyo, Japan

[21] Appl. No.: 257,694

[22] Filed: Oct. 14, 1988

[30] Foreign Application Priority Data

Oct. 14, 1987 [JP] Japan ..... 62-260616

[51] Int. Cl.[4] ..... F02D 41/16

[52] U.S. Cl. ..... 123/339; 123/585

[58] Field of Search ..... 123/339, 340, 585, 587, 123/588, 589; 364/431.05, 431.07

[56] References Cited

U.S. PATENT DOCUMENTS

| | | | |
|---|---|---|---|
| 4,344,399 | 8/1982 | Matsumura et al. | 123/339 |
| 4,545,348 | 10/1985 | Ikeura | 123/339 X |
| 4,545,349 | 10/1985 | Ito et al. | 123/339 |
| 4,702,210 | 10/1987 | Yasuoka et al. | 123/339 |
| 4,729,359 | 3/1988 | Tomisawa et al. | 123/339 X |
| 4,747,379 | 5/1988 | Oba | 123/339 |
| 4,777,918 | 10/1988 | Yasuoka | 123/339 |
| 4,785,780 | 11/1988 | Kawai | 123/339 |
| 4,827,885 | 5/1989 | Nishikawa et al. | 123/339 |

*Primary Examiner*—Willis R. Wolfe

*Attorney, Agent, or Firm*—Beveridge, DeGrandi & Weilacher

[57] ABSTRACT

A control method for the idling speed of an engine, in which method, from the engine speed at the time when transition toward the idling state is determined by the switching, for example, of an idling switch to "ON", the correction quantity of the control value of valve means for regulating the intake air quantity of the engine is set, a drop in the engine speed being avoided, and at the same time, in the convergence toward a learned value thereafter, convergence to the learned value of the valve means at a variation rate corresponding to the engine speed is made possible, whereby rapid correspondence toward feedback control is realized.

1 Claim, 4 Drawing Sheets

CONTROL METHOD FOR IDLING SPEED OF AN ENGINE

BACKGROUND OF THE INVENTION

This invention relates generally to internal combustion engines and control thereof and more particularly to a control method for the idling speed of an engine by feedbacking the actual speed to an objective speed.

Method of this character of controlling the idling speed of an engine are known, for example, as disclosed in Japanese Laid-Open Patent Publication No. 155239/1983. In such a method, there is a step of transition to feedback control of an idling speed control valve serving as a valve means for regulating the intake air quantity of the engine in accordance with the load and operational state of the engine. In this step the idling state is detected, and, when it is determined that the engine is in a high-speed state, the idling speed control valve is controlled to a specific initial control value. Then, after the elapse of a predetermined time, the speed is gradually brought at a specific variation rate into convergence with a learned opening degree of the idling speed control valve learned during the preceding feedback control.

By this control method, since the correction quantity of the control value of the idling speed control valve is constant, there arises problems such as a temporary drop in the engine speed at the time of transition to idling state or poor convergency toward the idling speed. That is, if the correction quantity of the control value of the idling speed control valve is set at a small quantity, the drop in the engine speed will become large at the time of transition of the engine speed from the high-speed region to the idling state. If this correction quantity is set at a large quantity, the convergency toward the idling speed will become poor at the time of transition of the engine speed from the low speed region to the idling state.

Accordingly, one corrective measure which might appear to be feasible is to set the correction quantity of the valve control value, at the time of transition to the idling state, as a function of the engine speed at that time. In this case, however, if the engine speed is high at the moment of transition to the idling state, the correction quantity of the valve control value will become large, and the reduction of the valve control value from the initial control value to the learned value will require much time, whereby the convergency toward the idling speed will become poor.

SUMMARY OF THE INVENTION

Accordingly, this invention seeks to provide a control method the idling speed of an engine, in which method, from the engine speed of the time when transition toward the idling state is determined by the switching, for example, of an idling switch to "ON", the correction quantity of the control value of a valve means for regulating the intake air quantity of the engine is set, a drop in the engine speed being avoided, and at the same time, in the convergence toward a learned value thereafter, convergence to the learned value of the valve means at a variation rate corresponding to the engine speed is made possible, whereby rapid correspondence toward feedback control is realized.

According to this invention, there is provided a control method for the idling speed of an engine by providing a valve means for regulating the suction air quantity of the engine and feedback controlling the control value of said valve means so that the actual idling speed becomes an objective speed, said method comprising the steps of: monitoring pertinent variables indicating the load operation state of the engine; setting, from said load operation state, a control value correction quantity of said valve means in accordance with the engine speed at the time of transition to the idling state in the process of transition to feedback control of the idling speed; setting an initial control value by applying said control value correcting quantity to a learned value of said valve means learned during the preceding feedback control; maintaining a predetermined time the control value of the valve means at said initial control value; thereafter causing the valve control value to converge to a specific offset value proportional to said learned value at a variation rate set in accordance with the engine speed at the time of transition to said idling state; and resuming feedback control at that time.

Thus, in correspondence with the engine speed at the time of transition to the idling state, the correction quantity of the control value of the valve means is determined, and, in order to set the initial control value, the control value of the valve means by which a drop in the engine speed can be avoided in the case of high engine speed can be maintained. Moreover, since the initial control value can be determined at an initial control value of minimum necessary value corresponding to the engine speed, the convergency of the engine speed from the initial control value is improved. Furthermore, the rate of variation, after holding the control value of the valve means at the initial control value for a predetermined time, from the initial control value to the learned opening degree for resuming the feedback is set in correspondence with the engine speed at the time of transition to the idling state, for example, as a function of the engine speed. The convergency therefore can be improved, and moreover, other benefits such as suppression of pressure fluctuation in an intake passage can be attained.

The nature, utility, and further features of this invention will be more clearly apparent from the following detailed description with respect to a preferred embodiment of the invention when read in conjunction with the accompanying drawings, briefly described below.

DETAILED DESCRIPTION OF THE PREFERRED EMBODIMENTS

Figure 1:
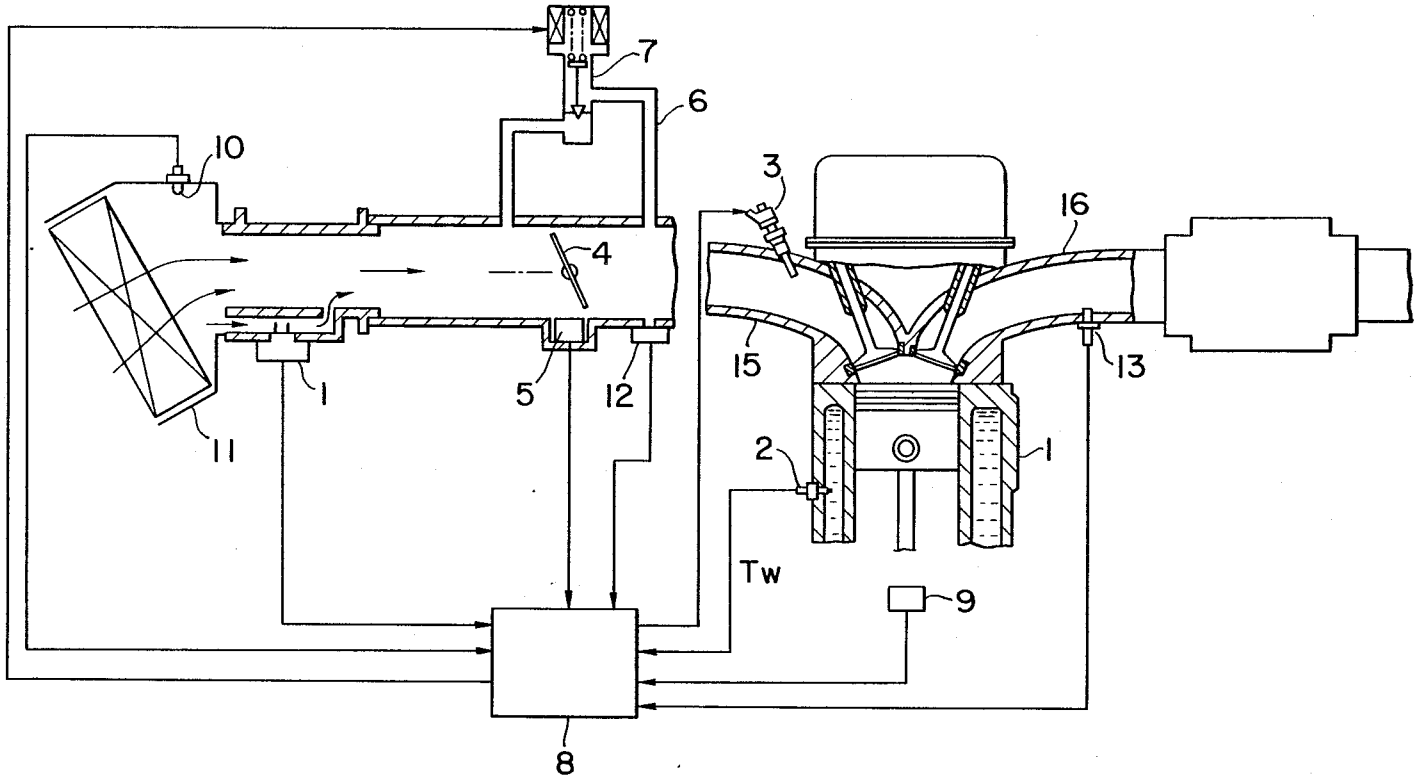
FIG. 1 is a combination of a schematic diagram, in longitudinal section, and a block diagram of pertinent parts of an engine and an example of a control system for practicing the control method according to this invention.

Referring first to FIG. 1, the engine 1 shown therein has a cylinder with a water jacket through which is passed cooling water, the temperature of which is monitored by a cooling water temperature sensor 2. To the cylinder head of the cylinder are connected a intake passage 15 and an exhaust pipe 16 which are respectively communicated with the combustion chamber of the cylinder via intake and exhaust valves as shown. Through the intake passage 15 at its part close to the intake valve is installed a fuel injector 3. A throttle valve 4 is installed within the intake passage 15 upstream from the fuel injector, and at a position in the wall of the intake passage 15 to confront the throttle valve 4 is installed an idling switch 5 for detecting the idling state.

A bypass passage 6 is provided parallelly across the throttle valve 4, being connected to the intake passage 15 on the upstream and the downstream sides of the throttle valve 4. At an intermediate part of this bypass passage 6 is installed an idling speed control valve (hereinafter referred to as the ISC valve) 7 serving as valve means for regulating the intake air quantity (flow rate) of the engine at the idling speed state. The controlling value of this ISC valve is set by the duty ratio of a control signal applied by a control unit or circuit 8. Into this control circuit 8 are supplied, as input, detection signals respectively from the above mentioned cooling water temperature sensor 2, the idling switch 5, a crank angle sensor 9, an intake air temperature sensor 10 installed upstream from the throttle valve 4, for example, in an air cleaner 11 installed at the intake end of the intake passage 15, an intake air pressure sensor 12, and an oxygen ($O_2$) sensor 13 installed in the intake passage 15 and the exhaust pipe 16 respectively.

Figure 2:
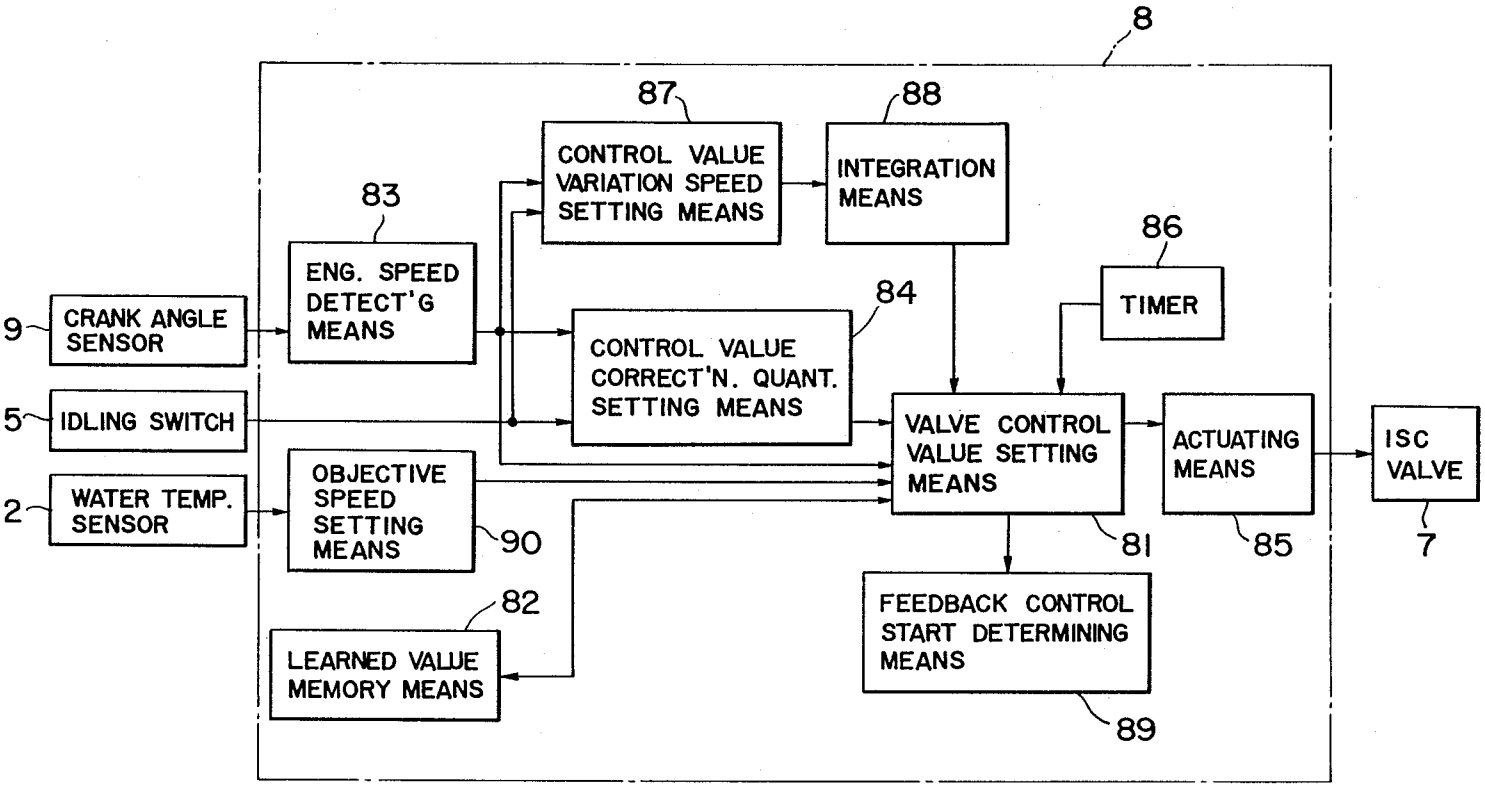
FIG. 2 is a block diagram showing the organization of the essential components of a control circuit used in the control method of the invention.

As shown in FIG. 2, the control circuit 8 comprises essentially ten functional components or means, among which is valve control value setting means 81, to which is applied a learned value of the ISC valve 7 which has been learned during the preceding feedback control from a learned value memory means 82. The learned value of the ISC valve 7 is set by taking the average value of preceding learned value and the present control value of the valve, for example, when the learning conditions have been satisfied.

The control circuit 8 is further provided with engine speed detecting means 83 which detects the engine speed from the output detection signal detected by the crank angle sensor 9 and generates an engine speed signal which is applied to a control value correction quantity setting means 84. This control value correction quantity setting means 84 operates at the instant when the idling switch 5 is "ON" to set the control value correction quantity of the ISC valve 7 that is in accordance with the engine speed at that time from a previously determined function, map, or the like. The resulting output signal of this means 84 is transmitted to the valve control value setting means 81, where it is applied to the learned value from the learned value memory means 82, and an initial control value is set in accordance with the engine speed at the transition to idling.

On the basis of this initial control value, an actuation signal is transmitted from the valve control value setting means 81 to the valve actuating means 85, and adjustment of the control value of the ISC valve 7 is accomplished. In the valve control value setting means 81, as a result of the functioning of a timer 86, the correction quantity of the control value of the ISC valve 7 is maintained during a predetermined time, and the control value of the ISC valve 7 is held at its initial control value.

On the other hand, when the idling switch 5 is turned "ON", the engine speed signal at that time is applied from the engine speed detecting means 83 to control value variation speed setting means 87, in which a function corresponding to the engine speed is thereupon selected and set. The output signal of this means 87 is applied to integration means 88, which thereupon transmits an integrated value in accordance with the above mentioned function to the aforementioned valve control value setting means 81. In this means 81, after the elapse of a predetermined time set by the timer 86, the control value of the ISC valve 7 is varied from the initial control value in accordance with the above mentioned integrated value, and the control value of the ISC valve 7 is changed to an offset value previously set with respect to the learned value. When this state has been attained, feedback control starting determinating means 89 outputs a signal for starting of feedback control of the idling speed.

When the feedback control is started, the valve control value setting means 81 varies the control value of the ISC valve 7 so that the actual engine speed inputted from the engine speed detecting means 83 coincides with the objective engine speed set by objective speed setting means 90 in accordance with the detection signal from the cooling water temperature sensor 2.

Figure 3:
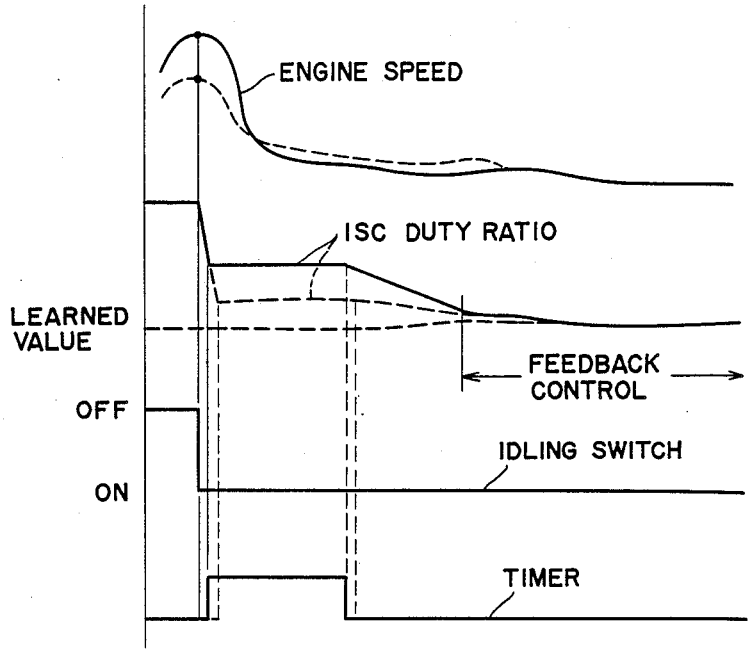
FIG. 3 is a graphical time chart indicating the essential functions involved in the idling speed control according to the invention.

In this manner, in the process from the time the idling switch 5 is turned "ON" to the commencement of feedback control, the ISC valve 7 is subjected to control of a required valve control value. The series of process steps as described above is indicated in the form of a time chart in FIG. 3. In this time chart, variations occurring at high engine speed are indicated by solid lines, while those occurring at low engine speed are indicated by intermittent lines. The function variations indicated are: the variation of engine speed; variation of the control value of the ISC valve 7; the "ON"/"OFF" states of the idling switch 5; and the timer operational time.

Figure 4:
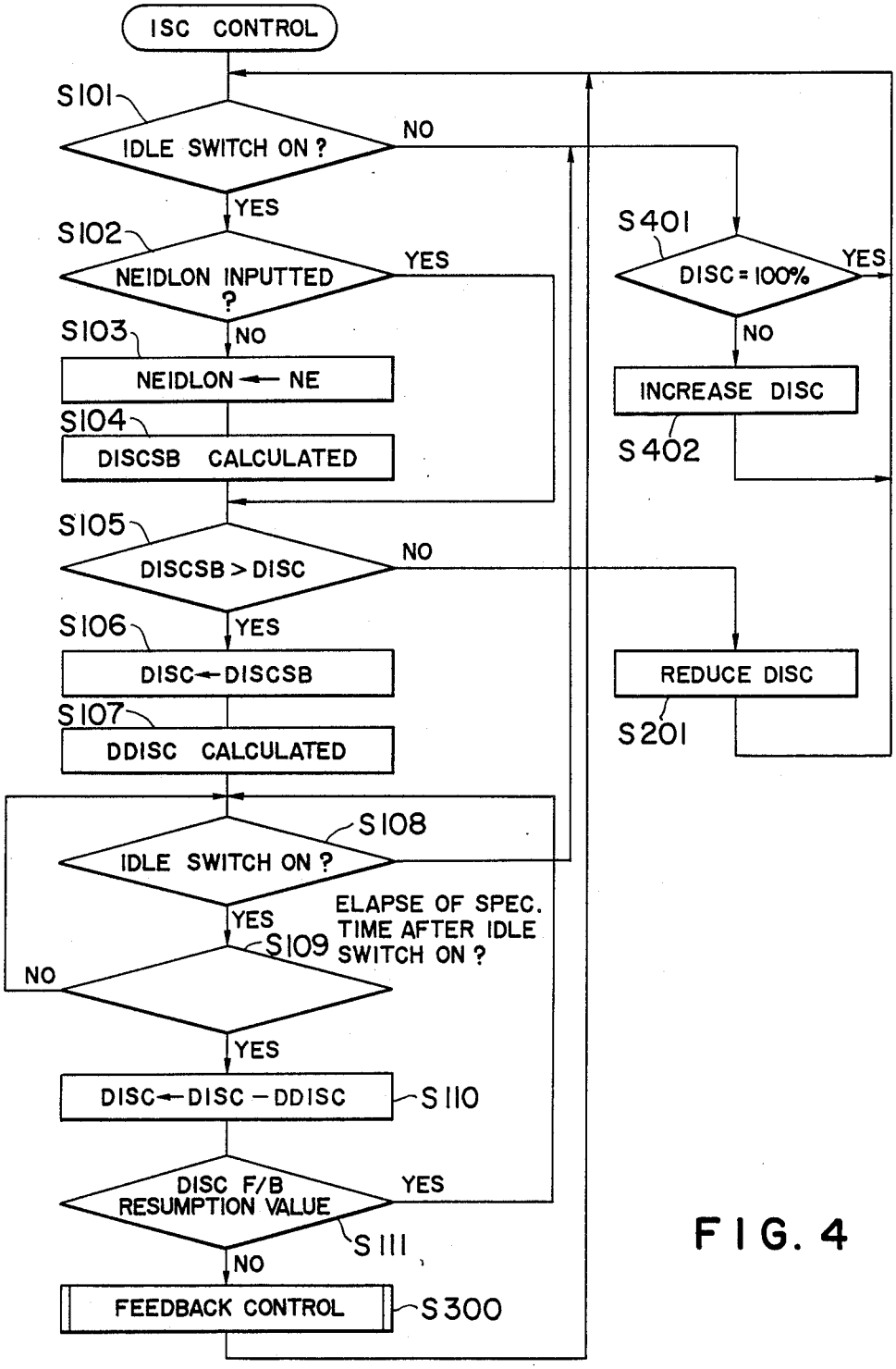
FIG. 4 is a flow chart of the procedural steps in the control method of the invention.

The steps in the operational routine performed in the control circuit 8 will now be described in conjunction with the flow chart of FIG. 4. First, in step S101, the "ON"/"OFF" state of the idling switch 5 is determined. If it is "ON", in step S102, whether or not the engine speed has been input into the control circuit is determined. If the inputting has not been carried out, in step S103 the engine speed NE is stored in NEIDLON, and in step S104, the initial control value DISCSB is computed from NEIDLON and the learned value DISCLRN leaned in the feedback control of the preceding idling speed. If the inputting of the engine speed has already been completed, the two steps S103 and S104 are skipped and step S105 entered. Here, comparison of the control value DISC of the ISC valve 7 and the initial control value DISCSB is carried out. Then, if DISCSB is not equal to or greater than DISC, DISC is reduced at a constant rate in step S201 and returned to step S101.

When DISCSB is equal to or greater than DISC, DISC is made equal to DISCSB in step S106, and, in the succeeding step S107, the variation quantity DDISC of the control value DISC determined by NEIDLON is computed. Then, in step S108, the "ON"/"OFF" state of the idling switch 5 at that time is checked. If it is "ON", the process proceeds to step S109. Next, in step S109, determination of whether or not the time set in the timer 86 has elapsed is carried out. If it has not elapsed, the process returns to step S108, whereas if it has elapsed, the process proceeds to step S110. Here, DDISC is subtracted from DISC, and the resulting difference is compared in step S111 with a resumption value F/B of the feedback control which has been calculated to a constant offset value with respect to the learned value DISCLRN. Then, if DISC is greater than F/B, the process returns to step S108, whereas, if not, the process enters the feedback control step S300.

When it has been determined in each of steps S101 and S108 that the idling switch 5 is "OFF", since the control of the idling speed as described above is then unnecessary, whether or not DISC=100% is determined in step S401. If not, DISC is corrected to 100% in step S402.

As described above in some detail, this invention provides a control method the idling speed of an engine wherein the control value of valve means at the time of transition into the idling state is set at an initial control value corresponding to the engine speed at that time as is thus maintained for a predetermined time. Therefore, during the transition from a high engine speed to idling speed control, an engine speed drop can be prevented, and at the same time, since an initial control value of the minimum necessary value in correspondence with each engine speed can be set, the convergency of the engine speed can be improved. Furthermore, since the rate of variation from the above mentioned initial control value to the learned value, also, is set by the relationship with the engine speed at the time of the transition to the idling state, pressure variation in the intake passage can be suppressed, or, in the case where the initial control value is large, the convergency toward the learned value can also be improved.

What is claimed is:

1. A control method for the idling speed of an engine by providing valve means for regulating the suction air quantity of the engine and feedback of the control value of said valve means so that the actual idling speed becomes an objective speed, said method comprising the steps of:

monitoring pertinent variables indicating the load operation state of the engine;

setting, from said load operation state, a control value correction quantity of said valve means in accordance with the engine speed at the time of transition to the idling state in the process of transition to feedback control of the idling speed;

setting an initial control value by applying said control value correcting quantity to a learned value of said valve means learned during the preceding feedback control;

maintaining a predetermined time the control value of the valve means at said initial control value;

thereafter causing the valve control value to converge to a specific offset value with respect to said learned value at a variation rate set in accordance with the engine speed at the time of transition to said idling state; and resuming feedback control at that time.

* * * * *